US005450002A

United States Patent [19]

Dunk

[11] Patent Number: 5,450,002

[45] Date of Patent: Sep. 12, 1995

[54] CO-CONTROLLER FOR CONTROLLING AN LTC TRANSFORMER WITH A STANDARD VOLTAGE REGULATOR CONTROL

[75] Inventor: Michael P. Dunk, Racine, Wis.

[73] Assignee: Cooper Industries, Houston, Tex.

[21] Appl. No.: 990,700

[22] Filed: Dec. 15, 1992

[51] Int. Cl.[6] ..... G05F 1/153

[52] U.S. Cl. ..... 323/257; 323/255; 323/258; 323/340

[58] Field of Search ..... 323/255, 256, 257, 258, 323/340, 341, 343

[56] References Cited

U.S. PATENT DOCUMENTS

| | | | |
|---|---|---|---|
| 4,419,619 | 12/1983 | Jindrick et al. . | |
| 4,623,834 | 11/1986 | Klingbiel et al. | 323/258 |
| 4,630,220 | 12/1986 | Peckinpaugh | 323/257 X |
| 4,695,737 | 9/1987 | Rabon et al. | 323/257 X |
| 4,860,145 | 8/1989 | Klingbiel | 323/257 X |
| 5,136,233 | 8/1992 | Klinkenberg et al. | 323/343 |

OTHER PUBLICATIONS

McGraw-Edison Service Information Manual for the VR-32 Regulator and CL-4C Control, May 1990, pp. 2-37 to 3-3.

*Primary Examiner*—A. D. Pellinen
*Assistant Examiner*—Y. Jessica Han
*Attorney, Agent, or Firm*—Burns, Doane, Swecker & Mathis

[57] ABSTRACT

A co-controller provides communication between a standard voltage regulator controller and an LTC transformer, to enable the standard controller to be used in the operation of the LTC transformer. The co-controller generally consists of an interface circuit and a control circuit. The interface circuit receives status signals pertaining to the operation of an LTC transformer, as well as control signals from a voltage regulator controller, and buffers these signals for presentation to the control circuit. The control circuit is microprocessor based, and modifies the input signals from the interface circuit to provide the appropriate control signals required for the operation of the LTC transformer. The control circuit also implements a number of functions not available through a standard controller, such as current balance paralleling, overvoltage protection and correction for faults.

14 Claims, 8 Drawing Sheets

CO-CONTROLLER FOR CONTROLLING AN LTC TRANSFORMER WITH A STANDARD VOLTAGE REGULATOR CONTROL

BACKGROUND OF THE INVENTION

The present invention is directed to voltage regulating transformers, and more particularly to a controller which enables a load tap changing transformer to be controlled by means of a standard voltage regulator control device.

Transformers for providing a controlled output voltage can generally be classified as one of two types. One type, simply known as a voltage regulating transformer, is used in applications having low voltage and power requirements. The other type of transformer, a load tap changing (LTC) transformer, is generally a much larger device and is used in power transmission. These different types of transformers have different modes of operation and different control requirements. A voltage regulating transformer has small components and utilizes a small motor to adjust the output voltage. As a result, the controller for a voltage regulating transformer can be relatively simple in structure and operation. One example of a controller for a voltage regulating transformer is disclosed in U.S. Pat. No. 4,419,619.

In contrast, an LTC transformer is a much more complex and difficult device to control. For example, it is required to regulate a three-phase power supply. In addition, the input parameters that must be considered to provide proper control are different from those of a voltage regulating transformer controller. As a result, the controller for an LTC transformer is much more complicated and expensive than that for a voltage regulating transformer.

Controllers for voltage regulating transformers are in widespread use. As shown by the aforementioned U.S. patent, advances in controllers for voltage regulating transformers have kept pace with technology, and today's controllers are microprocessor-based devices which can be readily programmed to provide desired functions.

It would be desirable to utilize such a controller, which is designed for a voltage regulating transformer, to control the operation of an LTC transformer. However, because of the different types of control signals and input sensing that are required for an LTC transformer, it is not possible to use a standard voltage regulator control for the operation of an LTC transformer. For example, in many power transmission applications, it is desirable to connect multiple transformers, which receive power from different respective sources, in parallel to a single transmission line. With this type of arrangement, it is necessary to ensure that all transformers are operating at the same output voltage. Otherwise, if one transformer has a lower output voltage than the others, it will function as a current sink rather than contribute its proportionate share of power to the load. Accordingly, the control of an LTC transformer involves a procedure identified as current balance paralleling, in which the circulating current (reactive current) in the transformer is measured to be sure that a proper balance is maintained among all of the transformers connected to the line. A standard voltage regulator controller does not measure circulating current, and therefore is not able to perform this required procedure.

Another difference between an LTC transformer and a voltage regulating transformer is the fact that, due to the higher currents it conducts, the LTC transformer employs a vacuum interrupter to make and break the load current during a tap change. The controller for an LTC transformer must be able to detect a faulty vacuum switch, and reverse a tap change operation if such a fault is detected. A standard voltage regulator controller does not include these capabilities.

In the past, rather complex mechanisms which included external relays and timers were used to carry out the necessary control functions required by the various modes of operation of an LTC transformer. It is desirable, however, to provide a device which allows controllers for voltage regulating transformers to be employed with LTC transformers, and thereby simplify the control of LTC transformers while eliminating the need for complex external control mechanisms.

BRIEF STATEMENT OF THE INVENTION

In accordance with the present invention, a controller for a voltage regulating transformer can be used to control the operation of an LTC transformer by means of a co-controller that provides communication between a standard voltage regulator control and an LTC transformer. The co-controller generally consists of an interface circuit and a control circuit. The interface circuit receives status signals pertaining to the operation of an LTC transformer, as well as control signals from a voltage regulator controller, and buffers these signals for presentation to the control circuit. The control circuit is microprocessor-based, and monitors the input signals from the interface circuit to provide the appropriate control signals required for the proper operation of an LTC transformer. In addition, the control circuit implements safety functions that were not previously available in connection with LTC transformers.

Further features of the present invention, as well as the manner in which it achieves the foregoing objectives, are explained hereinafter with reference to the illustrated embodiment of the invention.

DESCRIPTION OF THE ILLUSTRATED EMBODIMENT

While the following description of the invention is made with reference to a particular embodiment to facilitate an understanding thereof, it will be appreciated that the principles underlying the invention are not limited to this specific embodiment. Rather, the invention has applicability to any situation in which it is desirable to control the operation of an LTC transformer by means of a standard voltage regulator controller, and can be embodied in a number of different forms that are suitable for the particular application.

Figure 1:
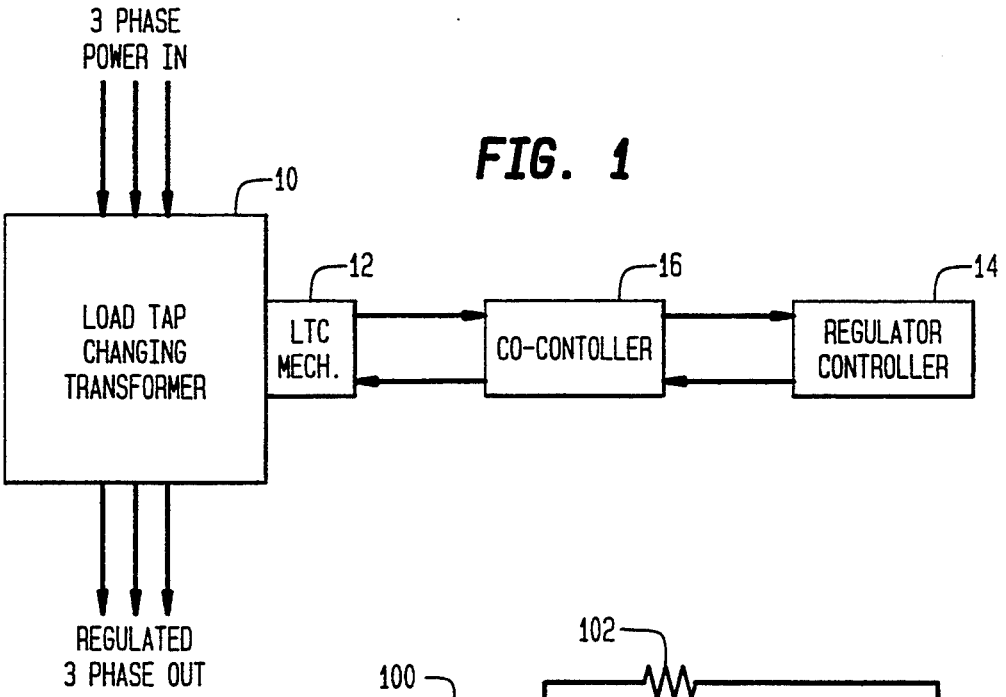
FIG. 1 a block diagram of a power transmission system incorporating a co-controller in accordance with the present invention.

A power transmission system incorporating a co-controller, in accordance with the present invention, is illustrated in block diagram form in FIG. 1. Referring thereto, the voltage from a three-phase power supply is fed to an LTC transformer 10, where it is regulated to produce an output voltage at a predetermined level, e.g., 120 volts. In operation, the input and output voltages of the transformer 10 are sensed and compared with the predetermined level. If the output voltage is not at the proper level, an LTC mechanism 12 is activated to adjust taps which determine the ratio of the input and output voltages of the transformer. The adjustment of the taps is carded out by energizing a motor to shift the position of a tap which contacts the primary or secondary winding of the transformer at various positions. The shifting of the position of the tap changes the number of effective turns in the primary or secondary winding, thereby changing the ratio of turns in the two windings. As a result, the ratio of the input and output voltages is raised or lowered, depending on the direction of the shift.

The load tap changing transformer 10, as well as the LTC mechanism 12, are well known devices. Therefore, their structure and operation will not be described in further detail herein, except as necessary to facilitate an understanding of the invention.

In accordance with the present invention, the actual control of the LTC mechanism is implemented with a standard controller 14 for a voltage regulating transformer. The controller 14 receives input signals relating to the output voltage of the transformer 10, the current being drawn by the load connected to the transformer 10, and the difference between the input and output voltages. In response to these input signals, the controller issues commands to raise or lower the output voltage of the transformer, as may be required to maintain the output voltage at a predetermined level established by the user. The structure and operation of the voltage regulator controller 14 is also well known in the art, and therefore not described in detail herein.

As discussed previously, a standard voltage regulator controller 14 is not suited to control the operation of the LTC mechanism on an LTC transformer. In accordance with the present invention, therefore, a co-controller 16 is provided to enable the regulator controller 14 to be used in the control of the LTC mechanism 12. In operation, the co-controller 16 receives the commands from the regulator controller 14, and modifies them in a manner which enables them to be utilized by the LTC mechanism 12. In addition, the co-controller 16 performs appropriate monitoring of the transformer conditions, and alters or supplements the commands to the LTC mechanism to ensure safe operation and provide functions not previously available.

Figure 2A:
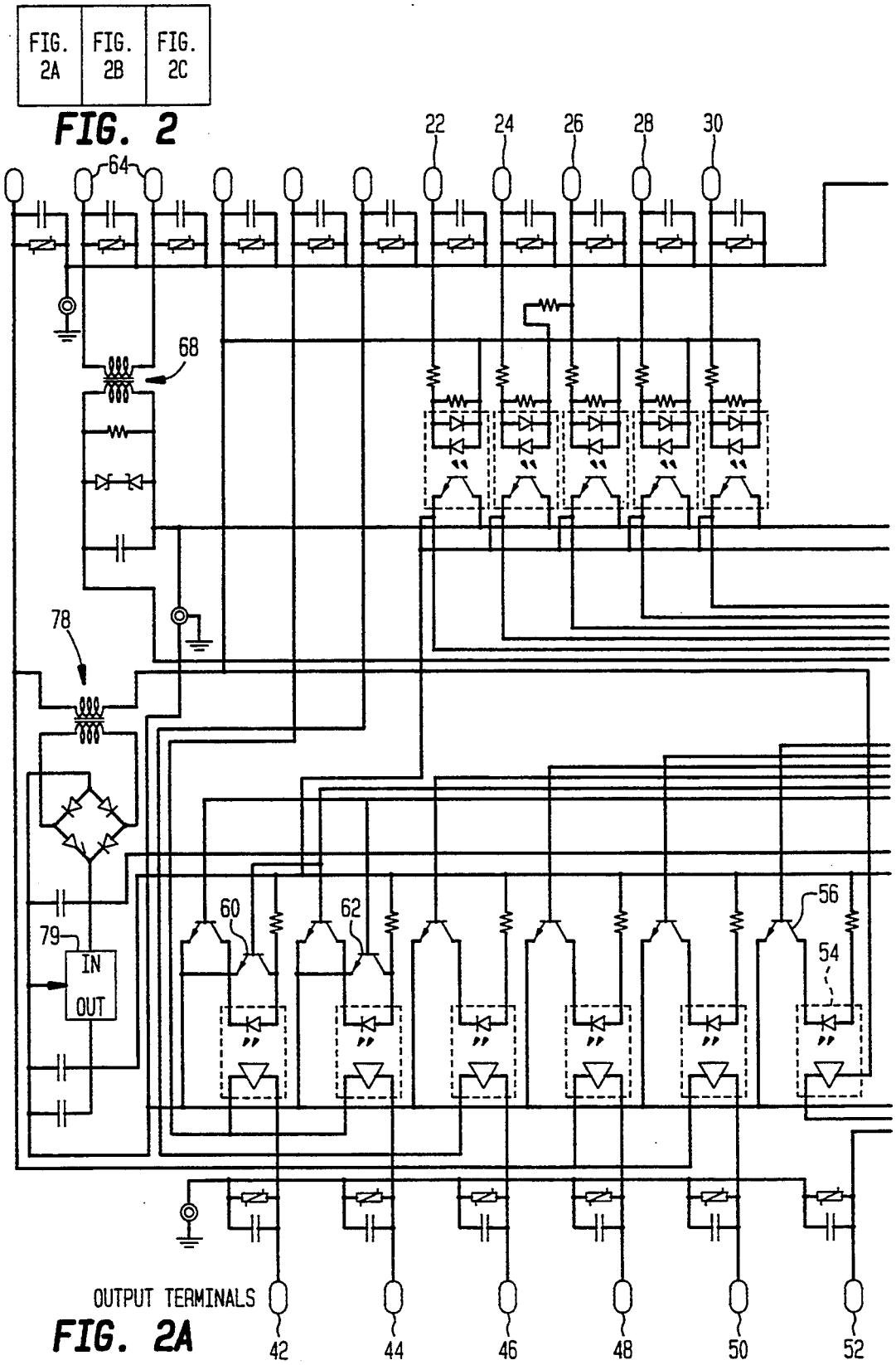
FIG. 2 is a schematic circuit diagram of the co-controller.
Figure 2B:
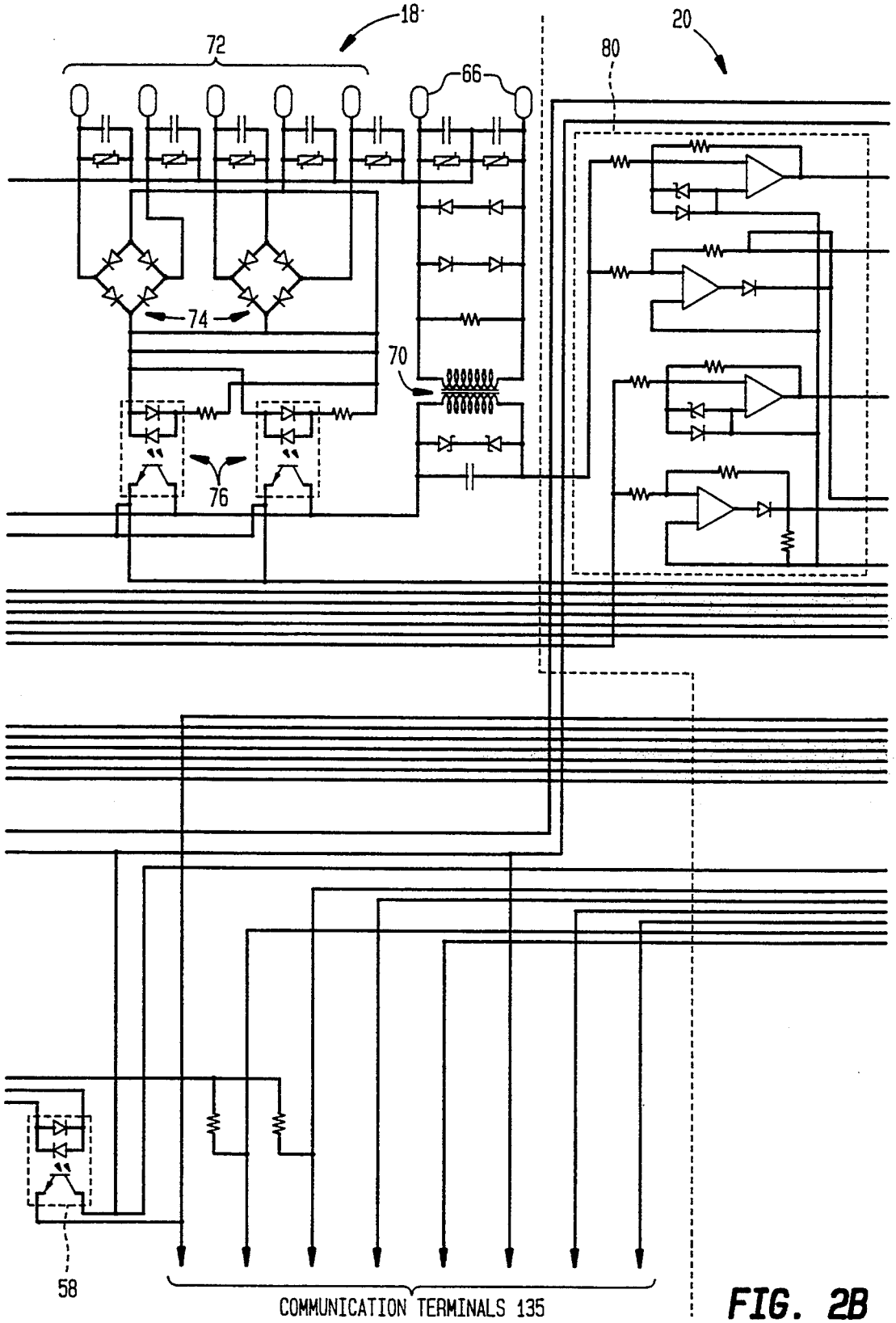
Figure 2C:
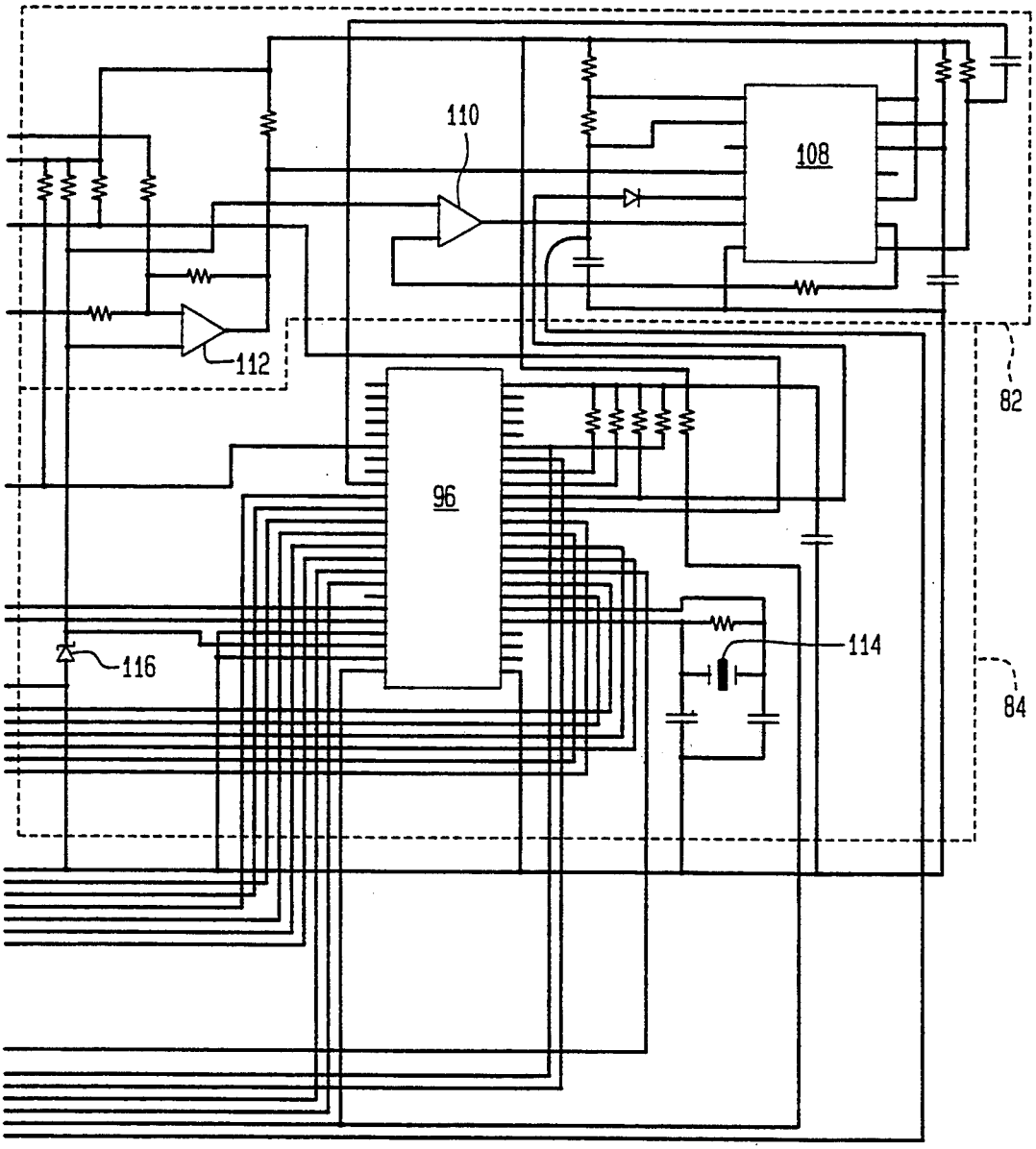

A schematic circuit diagram of the co-controller 16 is shown in FIG. 2. Generally speaking, the co-controller consists of two main circuits, an interface circuit 18 and a control circuit 20. In the embodiment illustrated in FIG. 2, the interface circuit includes five AC input terminals. One of these input terminals comprises a RAISE REQUEST terminal 22 for receiving a command signal from a relay contact in the regulator controller 14, to raise the output voltage of the transformer. A LOWER REQUEST input terminal 24 receives a command from another relay contact in the controller 14, to lower the output voltage of the transformer. A SEAL-IN input terminal 26 receives a signal from the LTC mechanism 12, indicating the status of a cam-operated sealing switch which is closed when a tap changing operation is in progress. A NEUTRAL SENSE input terminal 28 receives an input signal from a cam-operated switch which is closed when the tap mechanism is in its neutral position. A VFCAM input terminal 30 receives a signal indicating the status of a cam-operated switch which identifies when the vacuum interrupter for the LTC mechanism 12 is open.

Figure 3:
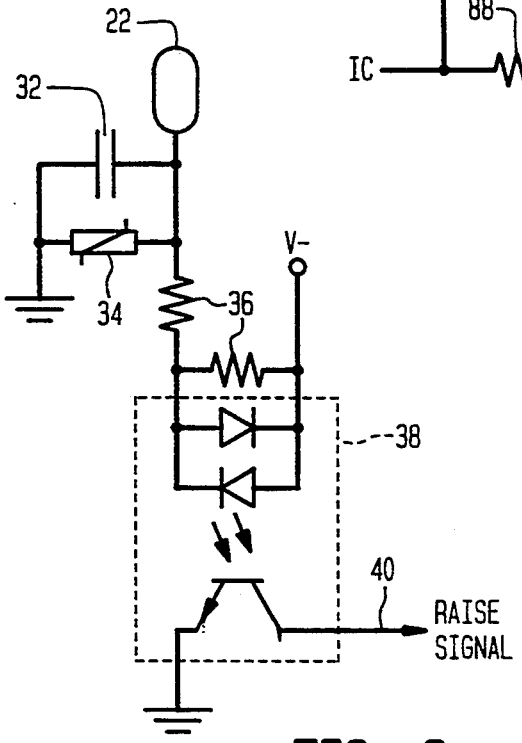
FIG. 3 is an enlarged schematic circuit diagram of the AC input terminal buffer circuit for the co-controller interface circuit.

Each of these five input terminals is connected to a respective buffer circuit. The structure of the buffer circuit is illustrated in detail in FIG. 3. Referring thereto, each input terminal, for example the terminal 22, is connected to an input surge suppressor, which includes a capacitor 32 and a varistor 34. This surge suppressor provides protection against high voltage spikes that may appear on the input terminal line. The input signals are scaled by a pair of resistors 36, and supplied to an AC input optical coupler 38. The output terminal 40 of the optical coupler leads to the control circuit 20.

Referring back to FIG. 2, the interface circuit 18 contains six AC output terminals. An RCON terminal 42 sends a signal to the raise contactor of the motor in the LTC mechanism 12, to thereby raise the output voltage of the transformer 10. An LCON output terminal 44 sends a signal to the lower motor contactor, and thereby lower the output voltage of the transformer 10. A BCON output terminal 46 sends a signal that controls the braking contactor on the motor in the LTC mechanism 12. An LOALRM output terminal 48 controls a lockout alarm, which indicates that a fault condition has locked out operation of the control system. A LOPALM terminal 50 controls a lock-out pending alarm, which indicates a blocking condition with a lockout pending. The sixth terminal 52 functions as both an input and output terminal. As an output terminal, it sends a signal to the LTC mechanism 12 to control whether it is in an automatic or manual state of operation. As an input terminal, it sends a signal to the control circuit 20 to indicate whether the LTC mechanism is in its automatic or manual state.

Each of the AC output terminals includes an optically isolated solid state relay 54. Each relay 54 receives a control signal from the control circuit 20 by means of an output transistor 56. In addition, each output terminal includes a surge protector, similar to that of the input terminals 22–30, to protect against voltage spikes on the line. The terminal 52, since it functions as both an input and an output terminal, is also connected to an AC input optical coupler 58, which sends a signal to the control circuit 20 regarding the state of operation of the LTC mechanism 12.

To prevent raise and lower contactor signals from being sent to the LTC mechanism simultaneously, the RCON terminal 42 and LCON terminal 44 are interconnected by means of a pair of interlock transistors 60 and 62. The transistor 60 receives the LCON signal from the control circuit 20, and functions to prevent the optically isolated relay for the RCON terminal 42 from being turned on while the LCON signal is being sent to the terminal 44. Similarly, the transistor 62 receives the RCON signal from the control circuit 20, and prevents the optically isolated relay for the LCON terminal 44 from being turned on while the RCON signal is being sent to the terminal 42.

The interface circuit includes input terminals for two analog signals. One of these signals, VOUT, is presented across a pair of terminals 64. The other analog input signal, IC, is presented across a pair of terminals 66. The input terminals for each analog signal are surge suppressed by a varistor and a capacitor, in the same manner as the AC input terminals. Each incoming analog signal is scaled and isolated by means of a respective transformer 68, 70. The output signals from the transformers are presented to the control circuit 20.

The interface circuit includes five current sensitive input terminals 72, which are used to detect a failure in the vacuum interrupters of the LTC mechanism 12. The input signal to each of these terminals is surge protected, and the signals are then rectified by diode bridges 74 and combined. The combined signals are presented to optical couplers 76, which provide an input signal VF to the control circuit 20. The combined signals are scaled by suitable resistors prior to presentation to the optical couplers, so that only input signals above a preset level will cause the optical couplers to be turned on.

The power supply for the LTC motor is also used to provide power to the co-controller. The input power is applied to a step-down transformer 78, after which it is rectified, filtered and regulated in a regulator 79, to provide the proper voltage for the operation of the circuit, e.g., five volts DC.

Figure 4:
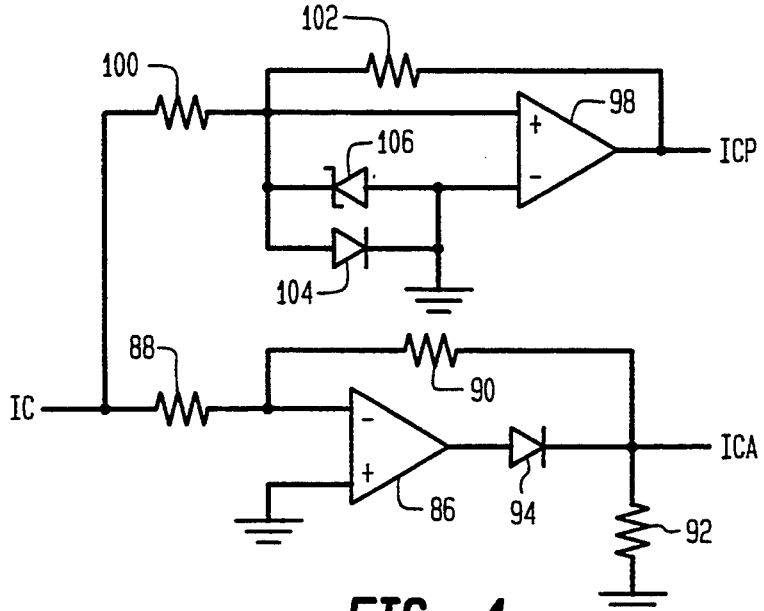
FIG. 4 is an enlarged schematic diagram of an analog signal conditioning circuit of the co-controller's control circuit.

The control circuit 20 is comprised of three basic circuits, an analog signal conditioning circuit 80, a watchdog/reset circuit 82 and a microprocessor circuit 84. The analog signal conditioning circuit receives and processes the two analog input signals VOUT and IC, in preparation for presentation to the microprocessor circuit 84. Referring to FIG. 4, each of the two analog input signals, for example the signal IC, is rectified and scaled by means of a precision rectifier comprising an operational amplifier 86, an input resistor 88, a set of feedback resistors 90 and 92, and a diode 94. The rectified output signal ICA is applied to a microprocessor 96 within the microprocessor circuit 84. The microprocessor 96 is preferably of the type having an internal analog-to-digital converter, such as the MC68HC811E2 microcontroller manufactured by Motorola. With this arrangement, the analog signal ICA is internally converted to a digital signal within the microprocessor.

The signal IC is also supplied to a zero crossover detector comprising a differential amplifier 98, an input resistor 100, a feedback resistor 102, a forward-biased diode 104 and a reverse-biased Schottky diode 106. The resulting output signal ICP indicates the phase of the current signal, and is directly supplied to the microprocessor 96.

In a similar manner, the VOUT input signal is rectified, scaled and presented as an analog input signal VOUTA to the microprocessor. Its phase is likewise detected and indicated to the microprocessor as a signal VOUTP.

The watchdog/reset circuit 82 includes a dual timer 108. During normal operation, the microprocessor 96 generates watchdog pulses WD at regular intervals. The timer 108 receives the watchdog pulses from the microprocessor and functions, in part, as a monostable multi-vibrator to stretch these pulses and present them to a shorting comparator 110. The timer 108 also functions, in part, as an astable oscillator. Pulses from the shorting comparator 110 reset the astable oscillator function of the circuit, thereby preventing it from timing out. However, if no watchdog pulse WD is received from the microprocessor within a predetermined period of time, e.g., 50 msecs, the astable oscillator times out and a reset pulse is applied to the microprocessor, to cause the microprocessor to reset itself. This operation prevents the microprocessor from erroneously causing tap changes.

The watchdog/reset circuit 82 includes a second comparator 112. This comparator monitors the unregulated voltage signal VUR from the motor's power supply. If the voltage level is too low, the comparator 112 holds the microprocessor 96 in its reset state until the voltage has stabilized.

The microprocessor circuit 84 includes the microprocessor 96, which is preferably of the single-chip variety, and includes RAM and EEPROM types of memories. The microprocessor circuit also contains appropriate support circuitry. The support circuitry includes a crystal 114 and associated capacitors for proper clock reference. In addition, a xener diode 116 provides a stable voltage reference, to ensure accuracy for the analog signal conditioning circuits and the reset circuit.

In operation, the regulating controller 14 monitors the voltage from the transformer 10. When the voltage departs from a preset standard, it sends commands to the co-controller 16 to raise or lower the output voltage. The co-controller functions to manage the timing and sequencing of the tap mechanism 12. Within the co-controller, the microprocessor 96 receives input signals provided by the interface circuit 18, and issues the appropriate commands to carry out required tap changes. Prior to issuing the commands, it performs various checks to determine whether the tap change is allowed. In addition, the microprocessor circuit monitors the status of the LTC transformer, and actuates alarms or issues commands for tap changes, as required. The monitoring and checking operations are carded out with reference to various parameters that are established by the user.

The functions of the co-controller are explained in greater detail hereinafter with reference to flow charts of FIGS. 5–8, depicting the primary routines in the operation of the microprocessor 96. In addition to the routines illustrated in FIG. 5–8, there are one or more background routines that are called in response to timed interrupts. During these background routines, the microprocessor continually samples the voltage and current signals VOUTA and ICA which have been converted to digital values. In addition, each of the digital signals at the input terminals 22, 24, 26, 28, 30, 52 and 72, as well as the signal ICP indicating the current phase, is regularly sampled. Preferably, each of these input signals is sampled a predetermined number of times during each cycle of the voltage waveform.

At regular intervals, the measured values for the current and voltage are compared against user-defined limits, to determine if any alarm conditions are present. For example, the voltage can be compared against a first level to see if it is too high. If the voltage exceeds this first limit, a flag can be set, or other type of indicator can be actuated, to identify the out-of-bounds condition. The voltage can also be compared against a second, higher limit. If this limit is exceeded as well, a different flag can be set to indicate the need to run the output voltage to a lower value.

The voltage can also be compared to a low limit, to see if it is too low, for example due to a faulty or incorrectly set regulator. If the voltage is less than the low limit, an appropriate flag can be set.

In a similar manner, the magnitude of the circulating current can be compared to first and second limits. If the current exceeds the first limit, a flag can be set to indicate the need to carry out a tap change in the appropriate direction. The direction for the tap change is determined by sampling the phase of the current signal, ICP, at the time of a crossover in the voltage signal VOUTP, to detect whether the current is leading or lagging the voltage. In this manner, the co-controller can detect the need for, and carry out, current balance paralleling.

If the current exceeds a second, higher limit, an appropriate flag can be set to indicate the need to block any further tap changes in the appropriate direction, to thereby prevent a further rise in the current.

When the digital signals are sampled, corresponding bits in a register are set to indicate the state of each digital signal. In addition, the background routines generate the watchdog pulse WD at regular intervals, to reset the watchdog timer circuit 82.

Figure 5:
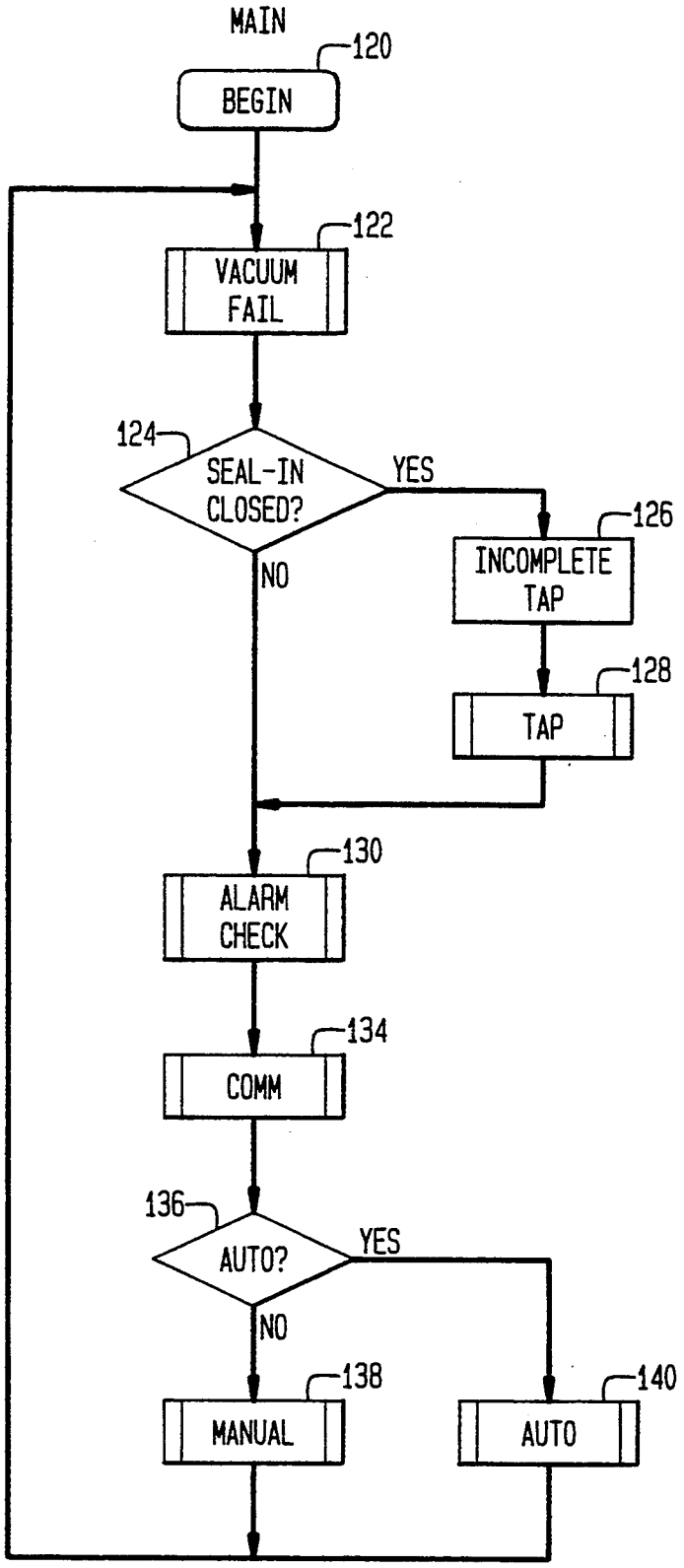
FIG. 5 is a flow chart of the main program for controlling the operation of the microprocessor within the co-controller.

The main control loop for the operation of the microprocessor 96 is illustrated in FIG. 5. After initialization and other startup routines at Step 120, the program proceeds to a subroutine at Step 122, which checks for vacuum fall lockout. In this subroutine, the microprocessor checks the contents of a counter which records the number of times previously attempted tap changes were aborted due to a faulty vacuum switch. If the contents of the counter reflects a preset number of aborted attempts, e.g. three, a lockout is put into effect. Once the lockout is in effect, the microprocessor waits until the system is manually reset.

If there is no lockout, or once it has been cleared, the microprocessor proceeds to Step 124 where it checks the state of the sealing switch. This switch is closed while a tap is in progress. If the switch is closed, the microprocessor sets an indicator to identify an incomplete tap at Step 126, and then calls the TAP subroutine at Step 128, to complete the tap. Thus, if the tap switch is left in an unsafe position between taps, for example due to a power failure or a mechanical problem, the polling of the sealing switch detects this condition and ensures the completion of the tap change. This feature is always active as long as the co-controller is being supplied with power.

If the sealing switch is not closed, the microprocessor proceeds to Step 130, where it calls a subroutine to check the status of the alarm flags which indicate whether the current or voltage exceeds preset limits. If any alarm flag is set, the microprocessor blocks a tap change from being carried out in a direction corresponding to the limit which has been exceeded. The microprocessor also determines whether the out-of-limit condition remains for a preset period of time. If it does, a lockout is set in place. When a lockout is established the microprocessor places the system in the manual mode of operation, by means of a signal at the output terminal 52. Conversely, if a lockout condition is not present and if there is no vacuum failure the system is allowed to operate in the automatic mode. The microprocessor then proceeds to Step 134, where it checks for any communications that may be received over a set of communication terminals 135 in the interface circuit 18.

At Step 136, the microprocessor checks the status of a flag which indicates whether the LTC mechanism is in its automatic or manual mode of operation. Depending on the status of the flag, the microprocessor proceeds to a manual control subroutine at Step 138, or an automatic control subroutine at Step 140. After carrying out one of these two subroutines, the loop is closed and the microprocessor returns to Step 122.

Figure 6:
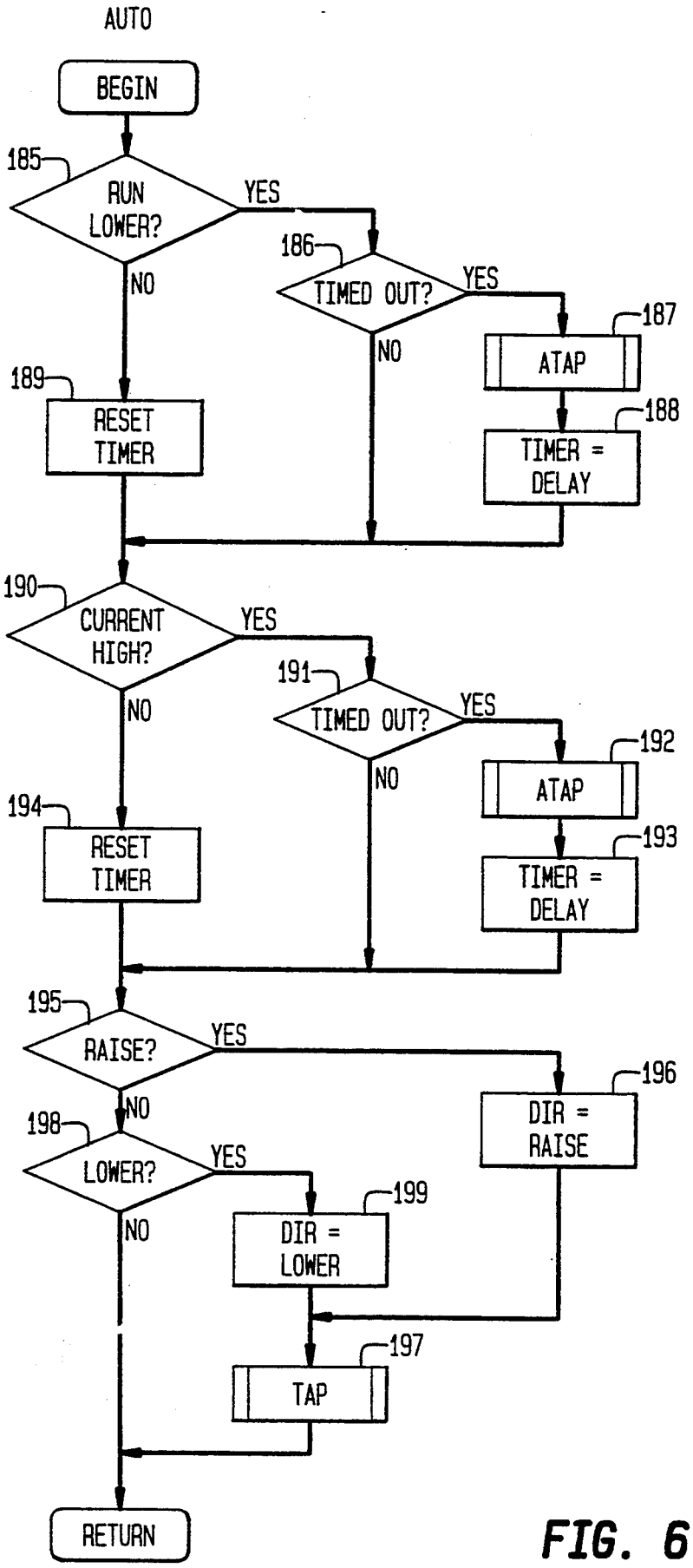
FIG. 6 is a flow chart illustrating the automatic mode subroutine for the co-controller's microprocessor.

FIG. 6 illustrates the flowchart for the automatic control subroutine that is called at Step 140 of the main control loop. This routine executes the automatic mode taps that are commanded by the controller 14. At Step 185 the microprocessor checks the status of the flag which indicates the need to run the output voltage to a lower value. If the flag has been set in the background routine, the microprocessor proceeds to Step 186, where it checks to see if a timer has timed out. If the timer has timed out, a subroutine ATAP is called at Step 187. In this subroutine, the commands from the controller 14 are temporarily blocked, and a tap change to lower the output voltage is carried out. The timer is then reset for a suitable delay period, e.g., 2 seconds, at Step 188. If the timer VITMR has not timed out at Step 186, no tap change is carried out. If the run lower flag is not set when it is checked at Step 185, the timer is reset to a preset value at Step 189.

At Step 190 the microprocessor checks to see if the high current flag has been set. If the flag is set, the microprocessor proceeds to Step 191, where it checks to see if another timer has timed out. If so, it calls the ATAP subroutine at Step 192, and then sets the timer for the delay period at Step 193. If the high current flag is not set, the timer is reset at Step 194.

Thus, whenever the voltage exceeds a preset limit, the co-controller operates in a run lower mode. Similarly, when the current exceeds its limit, the co-controller operates in a current balance paralleling mode. In these modes, tap changes are continually implemented with a preset time delay between each change, e.g. 2 seconds, until the voltage or current fall below the limit levels. The limit values, as well as the length of the delay between successive tap changes, are parameters whose values can be established by the user.

At Step 195 the microprocessor checks to see if a raise command from the controller 14 is present at the input terminal 22. If so, a direction bit DIR is set to the logic value associated with the raise direction at Step 196, and the TAP subroutine is then called at Step 197. If no raise command has been sent from the controller 14, the microprocessor proceeds to Step 198 and checks to see if a lower command is present at the input terminal 24. If so, the direction bit DIR is set to the logic value associated with the lower direction at Step 199, and the microprocessor then proceeds to Step 197 to call the TAP subroutine. If no raise or lower command is present, or after completion of the tap change, the microprocessor returns to the main control loop.

Unlike the run lower operating mode of steps 185–189 or the current balance paralleling mode of steps 190–194, there is no time delay between tap changes which are carried out in response to commands from the regulator controller 14. This approach allows multiple taps to be carried out in rapid succession, to provide an averaging operation.

In the manual mode of operation depicted at Step 138 in FIG. 5, the microprocessor checks the status of manually operated switches that control the direction of tap changes. These manual switches are connected to the input terminals 22 and 24 as well as to the controller 14. If the raise or lower switch is closed by the operator, the microprocessor waits for a delay period suitable to eliminate spurious signals, e.g. 0.1 second, and then calls the TAP subroutine after setting the direction bit DIR to the appropriate value for the required direction.

Figure 7:
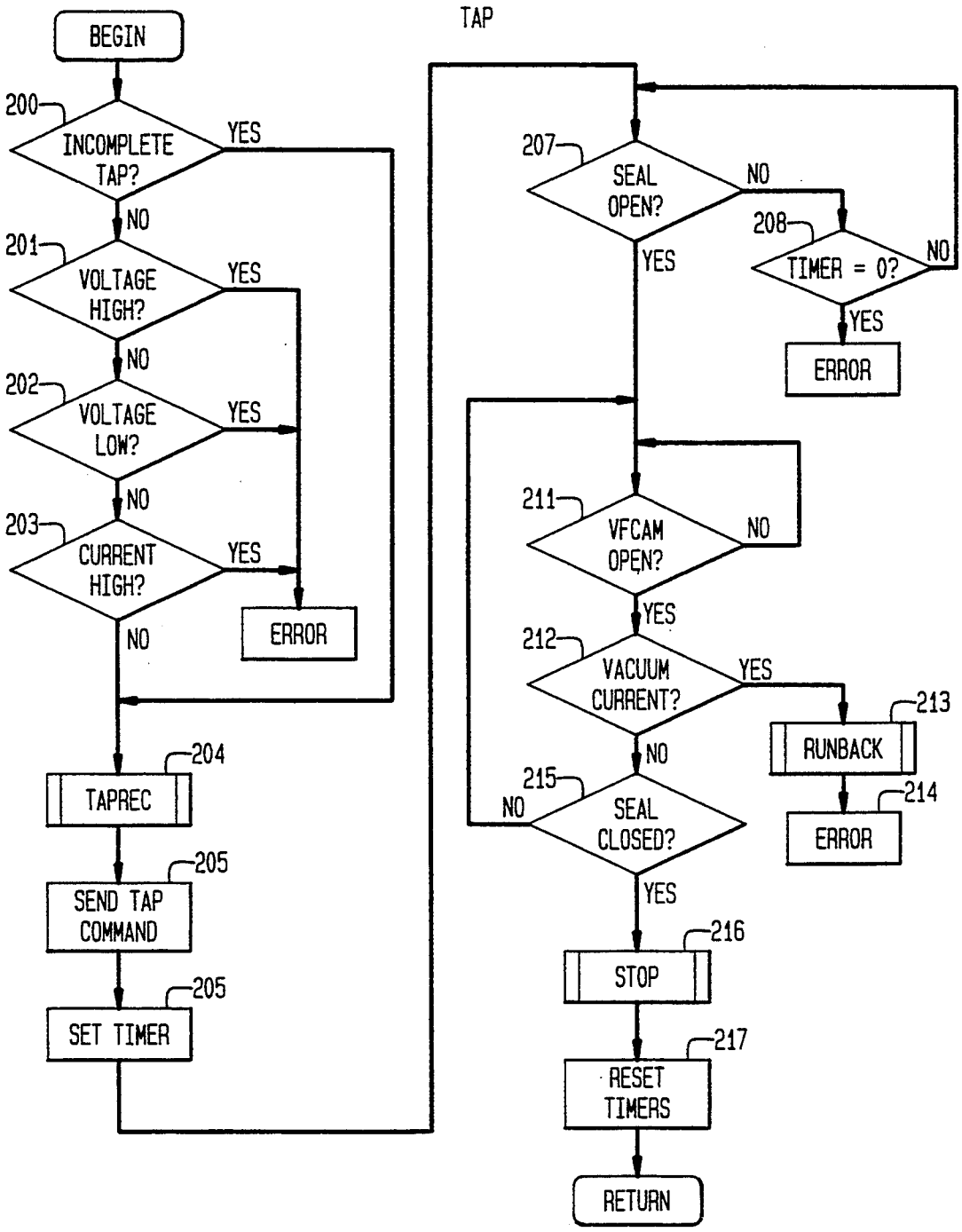
FIG. 7 is a flow chart illustrating the tap changing subroutine implemented by the co-controller's microprocessor.

FIG. 7 illustrates the tap subroutine which is implemented at Step 197 of the automatic control subroutine of FIG. 6, as well as during the manual control subroutine. This subroutine causes a single step tap change to be carried out each time it is called. Referring to FIG. 7, at Step 200 the microprocessor checks whether a tap changing procedure has been initiated but not yet completed. If not, the microprocessor checks for lockout conditions at Steps 201–203. For example, the lockout conditions could include high output voltage, low output voltage and high circulating current that have persisted for a predetermined time, as determined in the background routines. If a lockout condition is detected, an error condition is indicated and the controller 14 is forced into the manual mode by means of a signal at the terminal 52. No further steps are taken to change the tap, until the error condition has been removed.

If an incomplete tap has been detected, or if no error conditions are detected, the microprocessor calls a subroutine TAPREC at Step 204. In this subroutine, the microprocessor stores the direction and position of a tap change operation. To initiate the tap change operation, at Step 205 the microprocessor causes a raise or lower command to be presented to the appropriate output port. This command appears at the respective output terminal 42 or 44 of the interface circuit, to activate the motor in the LTC mechanism 12.

A timer is set for a suitable delay period, for example 5 seconds, at Step 206. During this time, the microprocessor checks the state of the sealing switch at Steps 207 and 208. If the switch does not close within the preset time period, the microprocessor moves to Step 210, where it sets an error indicator to identify a particular type of error, and indicates the error condition.

If the sealing switch is closed within the preestablished time, the microprocessor moves to Step 211, where it checks whether the VF cam has closed, as indicated by a signal at the input terminal 30. The microprocessor waits for the cam to close, and then proceeds to Step 212, where it checks the status of a flag that is set when a signal appears at any of the input terminals 72. If the flag is set, this is an indication that a vacuum bottle is faulty, which can result in unsafe operation of the LTC transformer. In this case, the microprocessor calls a run back subroutine at Step 213, which aborts the tap sequence and reverses the direction of the tap change. In addition, an error condition is indicated at Step 214, which can include forcing the system into the manual mode of operation.

If the vacuum fault current is not detected at Step 212, the microprocessor awaits the opening of the sealing switch, which indicates that the tap has been completed. During the time that the microprocessor awaits the opening of the sealing switch, it continuously checks the status of the VF cam and the vacuum switch currents to be sure that a vacuum fault current is not detected while the vacuum fault cam is closed. Once the sealing switch is detected to be open at Step 215, the microprocessor proceeds to a STOP subroutine at Step 216, in which the load tap changing motor is turned off and a DC brake is applied. After execution of this subroutine, the system timers are reset at Step 217, and the microprocessor returns to the main routine.

Figure 8:
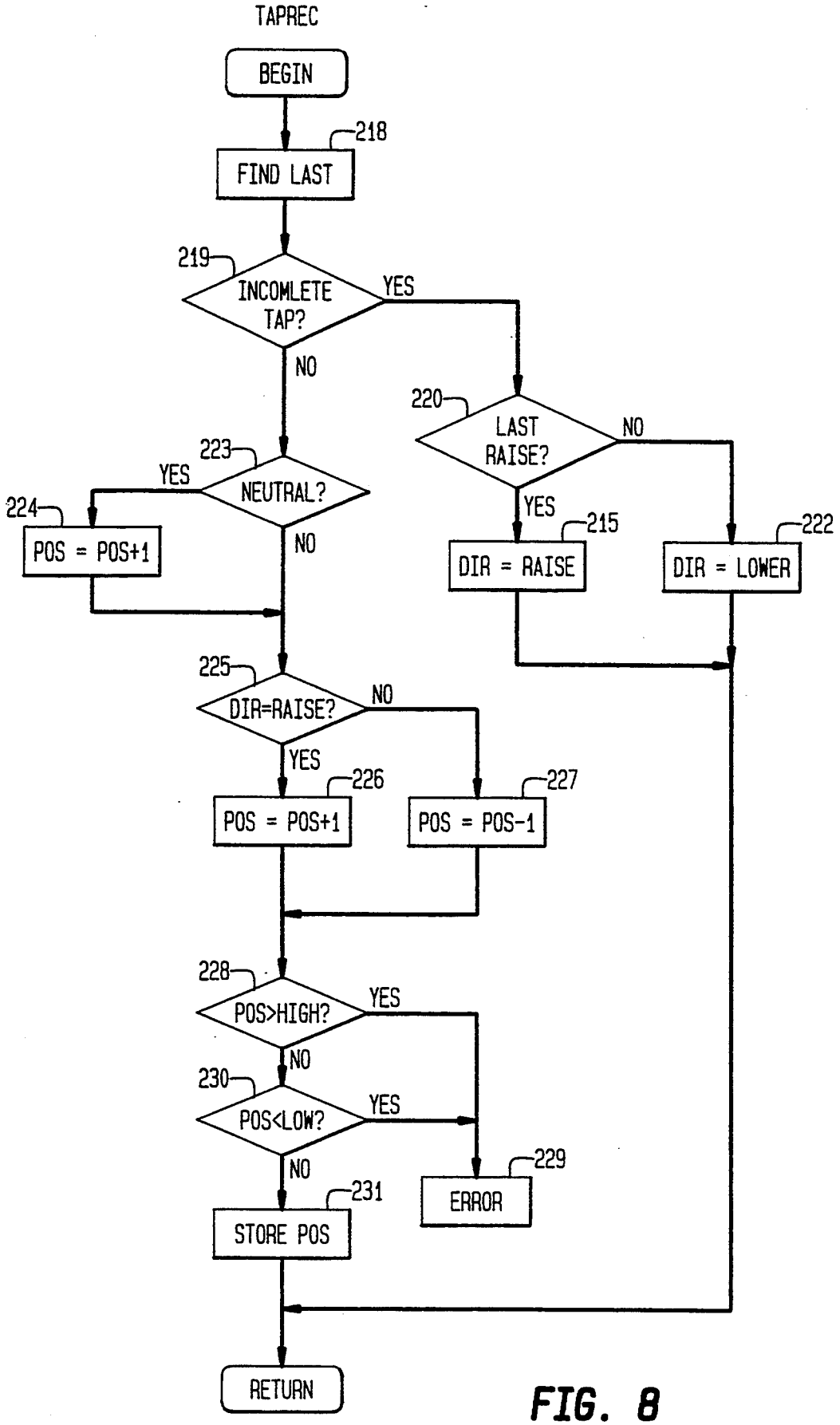
FIG. 8 is a flow chart illustrating the tap change recording subroutine for the microprocessor.

The TAPREC subroutine that is executed at Step 204 is illustrated in greater detail in the flow chart of FIG. 8. In this subroutine, the microprocessor stores the direction and position of a tap change. This information can be stored in the microprocessor's EEPROM as an 8-bit byte, which consists of one marker bit, one direction bit (DIR) and six position bits (POS). Referring to FIG. 8, at Step 218 the microprocessor retrieves the last tap entry that is recorded in the EEPROM memory of the microprocessor 96. It then checks whether an incomplete tap is in progress at Step 219. If so, at Step 220 the microprocessor checks to see if the direction of the last tap was raise. If so, it sets the direction bit to the raise value at Step 221. If the last tap direction was not raise, the microprocessor sets the direction bit to the lower value at Step 222. After setting this bit in either Step 221 or Step 222, the microprocessor returns to the tap subroutine.

If an incomplete tap was not detected at Step 219, there is no tap in progress, and the microprocessor proceeds to Step 223, where it checks the position of the neutral switch. If the neutral switch is closed, the microprocessor sets the position bits POS to the neutral value at Step 224. This procedure provides a reference for the microprocessor, so that the recorded position of the tap is regularly updated each time the switch is closed. Thereafter, the microprocessor proceeds to Step 225, where it checks the value of the direction bit (as set at Step 196 or 199). If the direction bit has a raise value, the value of the position bits POS is incremented by 1 at Step 226. Otherwise, the position bit value is decremented by one, at Step 227.

After the direction and position of a tap operation is recorded in this manner, the microprocessor checks the desired position against high and low limits. Thus, at Step 229, the value of the position bits POS is compared with a high limit. If the position value exceeds the high limit, an error condition is indicated at Step 229 and the tap change is aborted. If the position value does not exceed the high limit, it is then compared to a low limit at Step 230. If it is less than the low limit, the error condition is likewise indicated at Step 229. If the position value lies between the high and low limits, it is stored at Step 231, and the microprocessor returns to the TAP subroutine.

From the foregoing, it can be seen that the co-controller of the present invention enables a standard voltage regulator controller to be used to control the operation of a load tap changing transformer. The co-controller receives commands issued by the voltage regulating controller, and checks them against preestablished tap limits to determine whether a tap changing operation can be safely implemented. If so, the co-controller issues the appropriate commands to the load tap changing mechanism to carry out the desired operation.

In addition to implementing tap changes commanded by the regulator controller 14, the co-controller carries out a number of other functions that are not provided by a regulator controller. For example, it continually monitors the output voltage and circulating current in the LTC transformer, and automatically performs a run lower or a current balance paralleling operation as required. In addition, the system can be forced into a manual mode of operation, i.e. the regulator controller is locked out, if an unacceptable level of voltage or current exists for a predetermined period of time.

Other features offered by the co-controller of the present invention include the ability to identify and complete an incomplete tap change, and the detection of a faulty vacuum switch. When a faulty switch is detected during a tap change, the change is immediately aborted and the transformer is returned to its previous position, along with an appropriate warning of the faulty condition.

It will be appreciated by those of ordinary skill in the art that the present invention can be embodied in other specific forms without departing from the spirit or essential characteristics thereof. The presently disclosed embodiment is therefore considered in all respects to be illustrative and not restrictive. The scope of the invention is indicated by the appended claims rather than the foregoing description, and all changes that come within the meaning and range of equivalents thereof are intended to be embraced therein.

What is claimed is:

1. A device for controlling the operation of a load tap changing transformer in accordance with control signals generated by a voltage regulator controller, comprising:

an interface circuit for receiving status signals pertaining to the operation of the load top changing transformer and control signals from a voltage regulator controller, and for buffering said status and control signals; and a control circuit for receiving said buffered status and control signals and managing the timing and sequencing of a tap changing operation, including means responsive to a control signal requesting a tap change for storing the direction and location of the requested change;

means for determining whether the requested change will be allowed to take place;

signal generating means responsive to said determining means for providing a signal to said interface circuit to initiate a change in the requested direction;

means responsive to said status signals for aborting a change and returning the load tap changing transformer to a prior state in response to predetermined conditions; and means for providing signals to said interface circuit to complete the requested change in the absence of said predetermined conditions.

2. The device of claim 1, wherein said aborting means includes means for detecting a vacuum failure and automatically causing the load tap changing transformer to return to a prior condition upon detection of such a failure.

3. The device of claim 1 wherein said determining means detects the existence of a preset condition, and prevents a tap change operation from occurring if the preset condition is detected.

4. The device of claim 3 wherein said determining means also issues a command to place the voltage regulator controller in a manual mode of operation in response to detection of the preset condition.

5. The device of claim 1 wherein said determining means includes means for comparing a tap change to preset limits and for preventing a tap change from occurring if said limits are exceeded.

6. A device for controlling the operation of a load tap changing transformer, comprising:

a control circuit for receiving control signals from a voltage regulating controller requesting a tap change and for providing signals to a load tap changing transformer to implement a requested tap change; and means for monitoring the magnitude of circulating current in the load tap changing transformer and for generating signals to implement a tap change when said magnitude exceeds a preset current limit, regardless of control signals produced by the voltage regulating controller.

7. The device of claim 6 wherein said monitoring means also monitors the magnitude of an output voltage from the load tap changing transformer and generates signals to implement a tap change when said voltage magnitude exceeds a preset voltage limit, regardless of control signals produced by the voltage regulating controller.

8. The device of claim 7 wherein said monitoring means includes a programmed microprocessor that generates timed interrupts and, in response to said interrupts, compares the circulating current and the output voltage to said limits.

9. The device of claim 7 wherein said monitoring means continually generates signals to implement a tap change at predetermined intervals until said voltage magnitude is less than said preset voltage limit.

10. The device of claim 7 further including means for detecting whether the magnitude of the output voltage exceeds a second limit, different from said preset voltage limit, for a predetermined period of time, and for causing the load tap changing transformer to operate in a manual control mode when the magnitude of the output voltage exceeds said second limit for said period of time.

11. The device of claim 6 wherein said monitoring means continually generates signals to implement a tap change at predetermined intervals until said current magnitude is less than said preset current limit.

12. The device of claim 6 further including means for detecting whether the magnitude of the circulating current exceeds a second limit, different from said preset current limit, for a predetermined period of time, and for causing the load tap changing transformer to operate in a manual control mode when the magnitude of the circulating current exceeds said second limit for said period of time.

13. A device for controlling the operation of a load tap changing transformer in accordance with control signals generated by a voltage regulator controller, comprising:

a control circuit for receiving control signals from a voltage regulating controller requesting a tap change and for providing signals to a load tap changing transformer to implement a requested tap change;

an interface circuit for receiving status signals indicative of operating conditions of the load top changing transformer;

means responsive to said status signals for detecting a fault in the load tap changing transformer during a tap changing operation; and means responsive to said detecting means for aborting a tap change in progress and returning the load tap changing transformer to a prior state in response to detection of a predetermined fault condition.

14. The device of claim 13 wherein said predetermined fault condition is a current leak in a vacuum switch.

* * * * *